US006756567B1

(12) United States Patent
Suen

(10) Patent No.: US 6,756,567 B1
(45) Date of Patent: Jun. 29, 2004

(54) PARAFFIN WAX WARMER BATH

(76) Inventor: Chi Ming Suen, Hong Kong (CN)

( * ) Notice: Subject to any disclaimer, the term of this patent is extended or adjusted under 35 U.S.C. 154(b) by 0 days.

(21) Appl. No.: 10/252,066

(22) Filed: Sep. 19, 2002

(51) Int. Cl.[7] ..... F27B 14/00

(52) U.S. Cl. ..... 219/424; 219/430; 219/439; 219/432; 219/492; 4/493; 607/111

(58) Field of Search ..... 219/424, 426, 219/428–430, 432–433, 436, 439, 441, 442, 443.1, 444.1, 445.1; 4/493, 545; 607/111, 114

(56) References Cited

U.S. PATENT DOCUMENTS 3,619,560 A * 11/1971 Buiting ..... 392/480
6,184,500 B1 * 2/2001 Glucksman ..... 219/432
6,303,910 B2 * 10/2001 Glucksman et al. ..... 219/430
6,441,348 B1 * 8/2002 Yang et al. ..... 219/439

* cited by examiner

*Primary Examiner*—Shawntina Fuqua
(74) *Attorney, Agent, or Firm*—Lee W. Tower

(57) ABSTRACT

An apparatus for melting paraffin wax is provided. It includes an integral plastic inner tub attached to an integral aluminum plate holder, each of which has a flat bottom and a sloped wall. A positive temperature coefficient heating element is attached to the flat bottom of the aluminum plate holder for self regulating to a preset temperature by autonomously varying the positive temperature coefficient heating element electrical resistance in response to the temperature of the positive temperature coefficient heating element thereby varying a power dissipation of the positive temperature coefficient heating element in order to maintain the positive temperature coefficient heating element at the preset temperature. Heat from the positive temperature coefficient heating element is transferred from the integral aluminum plate holder to the integral plastic inner tub via the flat bottoms and the sloped walls thereby melting any wax inside the integral plastic inner tub. The electrical resistance of the positive temperature coefficient heating element decreases in response to the temperature of the positive temperature coefficient heating element decreasing thereby increasing the power dissipation and the temperature of the positive temperature coefficient heating element. The electrical resistance of the positive temperature coefficient heating element also increases in response to the temperature of the positive temperature coefficient heating element increasing thereby decreasing the power dissipation and the temperature of the positive temperature coefficient heating element.

12 Claims, 4 Drawing Sheets

PARAFFIN WAX WARMER BATH

BACKGROUND OF THE INVENTION

1. Field of the Invention

This invention relates to paraffin wax baths used for theraphy, particularly paraffin wax baths used for dermatological theraphy and arthritic treatment.

2. Description of the Related Art

For the treatment of arthritis and for moisturizing their skin, people may use paraffin wax baths. Solid paraffin wax is melted in the paraffin wax bath and then a person places his or her hand or foot into the melted wax inside the paraffin wax bath. When the person removes the hand or foot from the paraffin wax bath, a coating of paraffin wax is left applied to the skin. This procedure can relieve arthritic pain and can also be used for moisturizing the skin on a person's hand or foot.

An example of the related art can be found in U.S. Pat. No. 6,184,500 issued to Glucksman. The paraffin wax bath described therein is quite functional but is an expensive design. In particular Gluckman teaches side and base resistive heating elements 44 and 46 around and under the inner tub 14. This need for multiple resistive heating elements increases the cost of the article. Also, a resistive heating element requires a relatively expensive temperature control device to obtain consistent temperature control and to prevent the heating element from overheating. A resistive wire heating element does not provide for fast heating, is bulky and heavy. Additional circuitry is required to allow a resistive wire heating element to operate at more than one AC voltage level.

Accordingly, for these and other disadvantages of the prior art designs, there is a need in the art for a less expensive, functional paraffin wax bath.

SUMMARY OF THE INVENTION

It is an object of the present invention to provide a paraffin wax bath that provides all the functionality required while providing an economic alternative to resistance wire implementations. An object is to provide fast heating, self regulation with reliable consistent control, improved safety, and long life.

The present invention includes an integral plastic inner tub attached to an integral aluminum plate holder, each of which has a flat bottom and a sloped wall. A positive temperature coefficient heating element is attached to the flat bottom of the aluminum plate holder for self regulating to a preset temperature by automatically varying a wattage of the positive temperature coefficient heating element in order to maintain the positive temperature coefficient heating element at the preset temperature. Heat from the positive temperature coefficient heating element is transferred from the integral aluminum plate holder to the integral plastic inner tub via the flat bottoms and the sloped walls thereby melting any wax inside the integral plastic inner tub. An electrical resistance of the positive temperature coefficient heating element decreases as the temperature of the positive temperature coefficient heating element decreases as heat is drawn away from the positive temperature coefficient heating element thereby increasing the wattage of the positive temperature coefficient heating element. The electrical resistance of the positive temperature coefficient heating element increases as the temperature of the positive temperature coefficient heating element increases thereby decreasing the wattage of the positive temperature coefficient heating element. This temperature self regulation keeps the positive temperature coefficient heating element at the preset temperature.

Other objects and many of the attendant features of this invention will be more readily appreciated as the same becomes better understood by reference to the following detailed descriptions and considered in connection with the accompanying drawings in which like reference symbols designate like parts throughout the figures.

DETAILED DESCRIPTION

Figure 1:
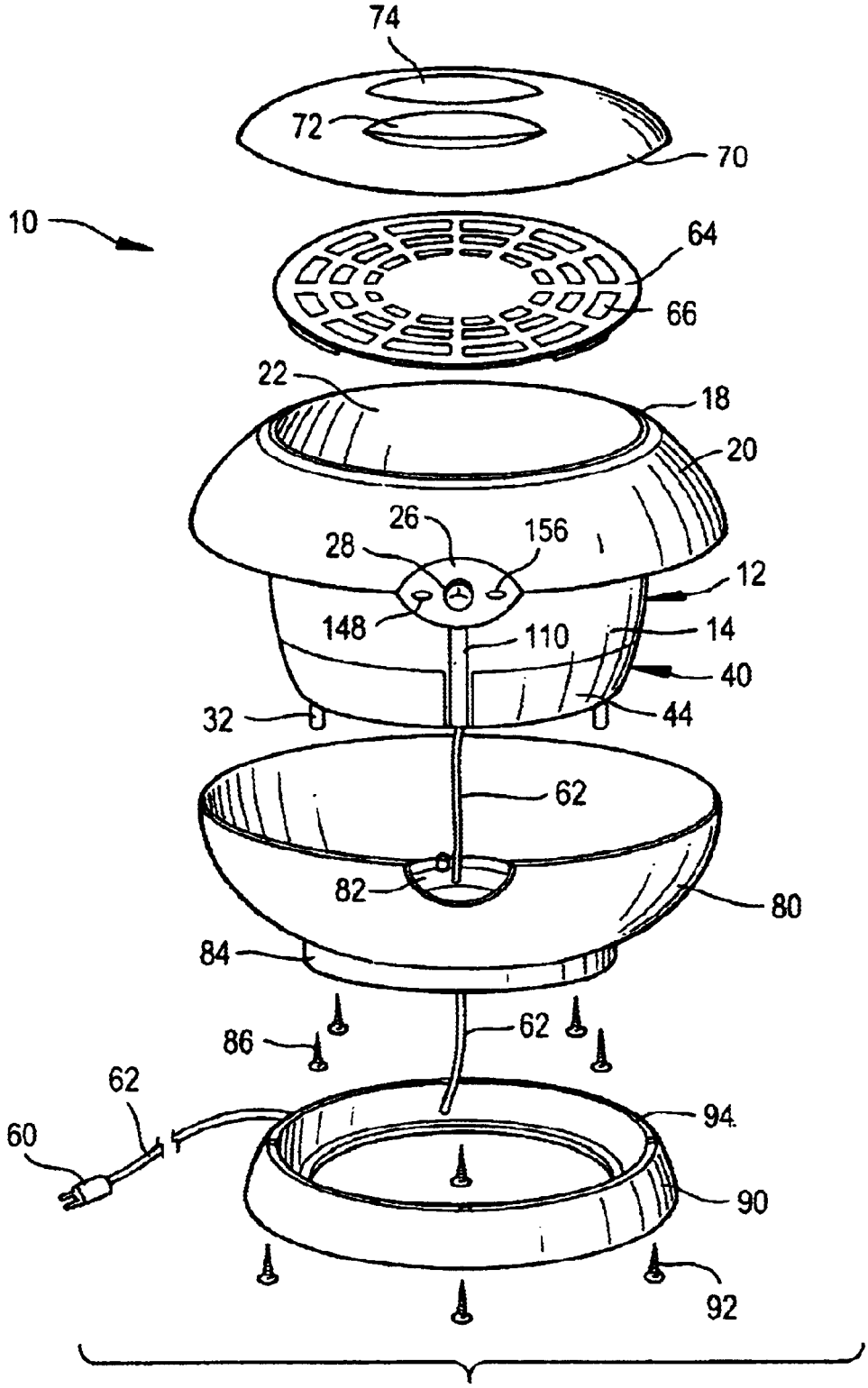
FIG. 1 is an exploded elevational perspective view showing the paraffin wax warmer bath in accordance with the present invention.
Figure 2:
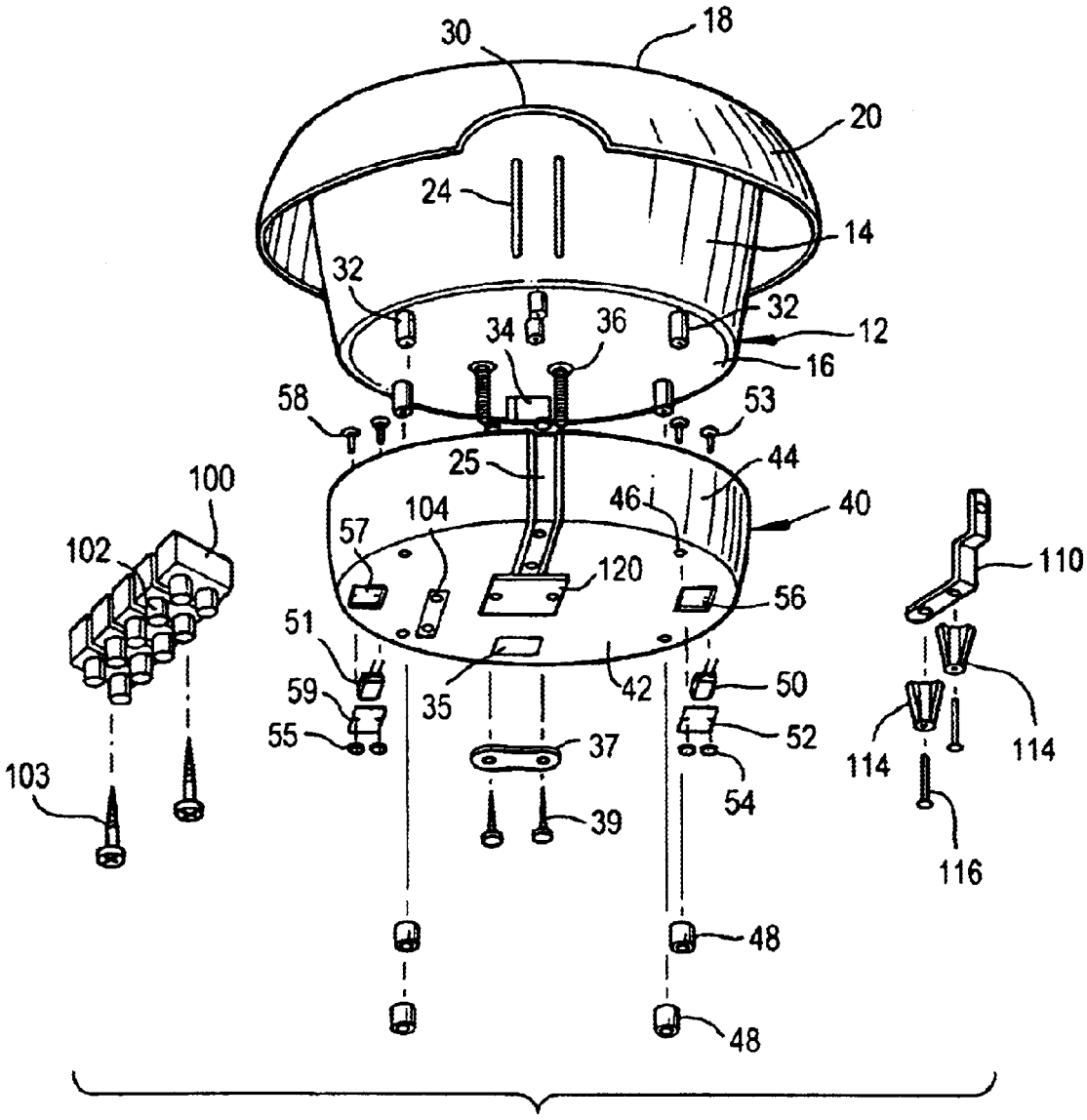
FIG. 2 is an exploded elevational perspective view showing the integral plastic inner tub and the integral aluminum plate holder of the paraffin wax warmer bath in accordance with the present invention.

Referring now to the drawings, FIG. 1 shows a paraffin wax warmer bath 10 for melting paraffin wax. The apparatus includes a plastic inner tub 12 having a sloped wall 14. As shown in FIG. 2, the plastic inner tub 12 has a flat bottom 16. At the top of the plastic inner tub 12, shown in FIG. 1, is a periphery 18, which defines an opening 22 in the top of the plastic inner tub 12. Paraffin wax is placed through opening 22 into the plastic inner tub 12 in order to melt the wax. A flaired lip 20 extends outward and downward from the periphery 18. Attachment points 32 are located on the bottom of the flat bottom 16. The sloped wall 14 has an alignment key 24.

The plastic inner tub 12 is mounted on an aluminum plate holder 40, which has a sloped wall 44. Sloped wall 44 is adapted to be similar in curvature to sloped wall 14. As further shown in FIG. 2, aluminum plate holder 40 has a flat bottom 42. The aluminum plate holder 40 is attached to plastic inner tub 12 by placing attachment points 32 through holes 46 on the aluminum plate holder. Washers 48 located on the bottom 42 of aluminum plate holder 40 provide a space between the aluminum plate holder 40 and plastic external tub 80 to which the assembled plastic inner tub and aluminum plate holder are attached using screws 86. The assembly is then attached to the plastic stand 90 using the screws 92. A flange 84 on the bottom of the plastic external tub 80 is designed to fit within the opening 94 on plastic stand 90. A plastic grate 64 with openings 66 fits within the opening 22 on the plastic inner tub 12. A cover 70 having finger grips 72 and 74 can be used to cover the opening 22 and is most useful when initially melting the wax or when maintaining the temperature of the melted wax between uses.

Power is supplied to the paraffin wax warmer bath 10 by plug 60 and power cord 62. A variable thermostat 28 is used to preset the temperature of the paraffin wax bath to a desired temperature for melting the wax. The variable thermostat 28 is mounted onto support 26. Plastic external tub 80 has a cut out 82 that is adapted to fit around the support 26.

Two neon lights 148 and 156 are mounted on the support 26. Neon light 148 is lit when the plug 60 is plugged into the power source. When the plug 60 is unplugged from the power source then neon light 148 is unlit. The variable thermostat 28 is turned or varied to set the desired preset temperature for the paraffin wax bath. Neon light 156 lights when power is being applied to a positive temperature coefficient heating element 122, which is further described in the FIG. 4 circuit description below. The brightness of neon light 156 depends on the preset temperature. If a high preset temperature is set then the neon light 156 is brightest. At a lower preset temperature the neon light 156 is dimmer. As further explained below, there is a maximum temperature on-off switch 50 that prevents the temperature of the paraffin wax bath from exceeding 85 degrees centigrade. If the temperature is above 85 degrees centigrade, then power is removed from the positive temperature coefficient heating element 122 and from the neon light 156 by maximum temperature on-off switch 50, so neon light 156 is not lit.

FIG. 2 shows additional details of the plastic inner tub and the aluminum plate holder. The aluminum plate holder 40 has an alignment key 25 that is adapted to fit into alignment key 24 on the plastic inner tub 12. When alignment key 25 is mated to alignment key 24, a bracket 110 fits within alignment key 25 and maintains the relationship between the plastic inner tub 12 and the aluminum plate holder 40. The bracket 110 is attached to the aluminum plate holder 40 via wingnuts 114 and nuts 116. The bracket 110 is also used to mount support 26, which supports the variable thermostat 28 and the neon lights 148 and 156. A terminal block 100 having terminals 102 is mounted at location 104 of the aluminum plate holder 40 and is used to connect the circuitry shown in FIG. 4.

A positive temperature coefficient heating element assembly 120, containing the positive temperature coefficient heating element 122, is mounted on the bottom of the flat bottom of aluminum plate holder 40. The positive temperature coefficient (PTC) heating element 122 has the capability to adjust the amount of heat emitted as environmental conditions change. Because of this capability, the PTC heating element 122 can achieve much greater cost effectiveness and higher safety than normal resistive wire heating elements. Cost effectiveness is achieved in three ways. First, the PTC heating element 122 combines the functions of a heating element and control unit in a single component, thereby eliminating the complex and expensive architecture associated with conventional resistive wire heating elements that require a temperature controller. Second, the PTC heating element 122 is cost-effective because it has a relatively large surface area with which to transfer heat to the bottom 42 of the aluminum plate holder 40, which improves heat transfer efficiency thereby saving energy. Third, the PTC-based heating element 122 can be set at a relatively low temperature which improves safety, especially for personal uses such as a paraffin wax warmer bath. This is in contrast with resistive wire heating elements that can reach increasingly high temperatures if not properly controlled.

The PTC heating element 122 has a unique resistance to temperature curve which results in the resistance decreasing as heat is drawn away and increasing as the temperature of the PTC heating element increases. This resistance varies the power (wattage) of the PTC heating element, according to the well known $P=V^2/R$ equation. The result is a heating element that self-regulates to a preset temperature and varies its wattage automatically in order to maintain that preset temperature. The PTC heat element response is also independent of the power supply voltage and, as a result, the PTC heating element can reach a constant temperature when operating with power voltages from 100 to 240, which allows the same design to be used for 110 volt AC power in the United States and 220 volt AC power in Europe and elsewhere.

Figure 3:
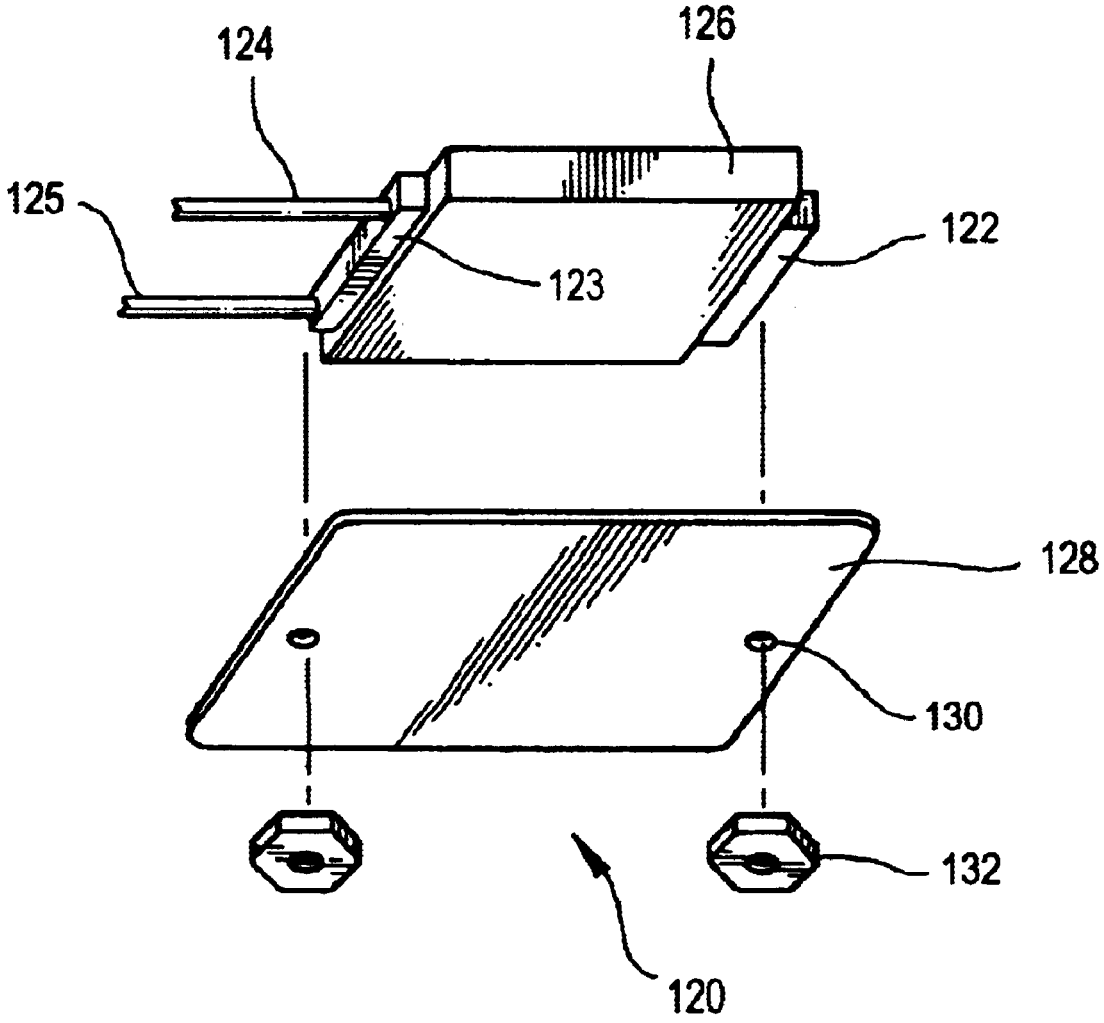
FIG. 3 is an elevational perspective view showing the positive temperature coefficient heating element assembly in accordance with the present invention.

FIG. 3 shows additional details of the PTC heating element assembly 120. The positive temperature coefficient heating element assembly 120 includes the positive temperature coefficient heating element 122, which has electrodes 124 and 125. The positive temperature coefficient heating element 122 is wrapped with an insulated high temperature resistant sheet 123 and is then placed within an aluminum case 126. A plate 128 with mounting holes 130 completes the PTC heating element assembly 120 and is used to mount the positive temperature coefficient heating element assembly 120 to the aluminum plate holder 40 via screws 36 and nuts 132.

As explained above maximum temperature on-off switch 50 prevents the temperature of the paraffin wax bath from exceeding 85 degrees centigrade. The maximum temperature on-off switch 50 is mounted on the aluminum plate holder 40 using bracket 52, screws 53 and nuts 54 onto location 56 of the aluminum plate holder 40. Also mounted on the aluminum plate holder 40 is power cutoff fuse 51. The power cutoff fuse 51 is mounted onto location 57 of aluminum plate holder 40 via bracket 59, screws 58 and nuts 55. If the current through the power cutoff fuse 51 exceeds a certain limit, then the power cutoff fuse 51 will blow and open, which immediately removes power from the PTC heating element 122. The power cutoff fuse 51 is an extra safety feature of the paraffin wax bath.

A bracket 37 on the bottom of the aluminum plate holder 40 is used to crimp the power cord 62. Hole 35 in the aluminum plate holder provides a space for the cord to be crimped onto crimp block 34 on the plastic inner tub 12. The bracket is held there with screws 39, which are screwed into crimp block 34.

Figure 4:
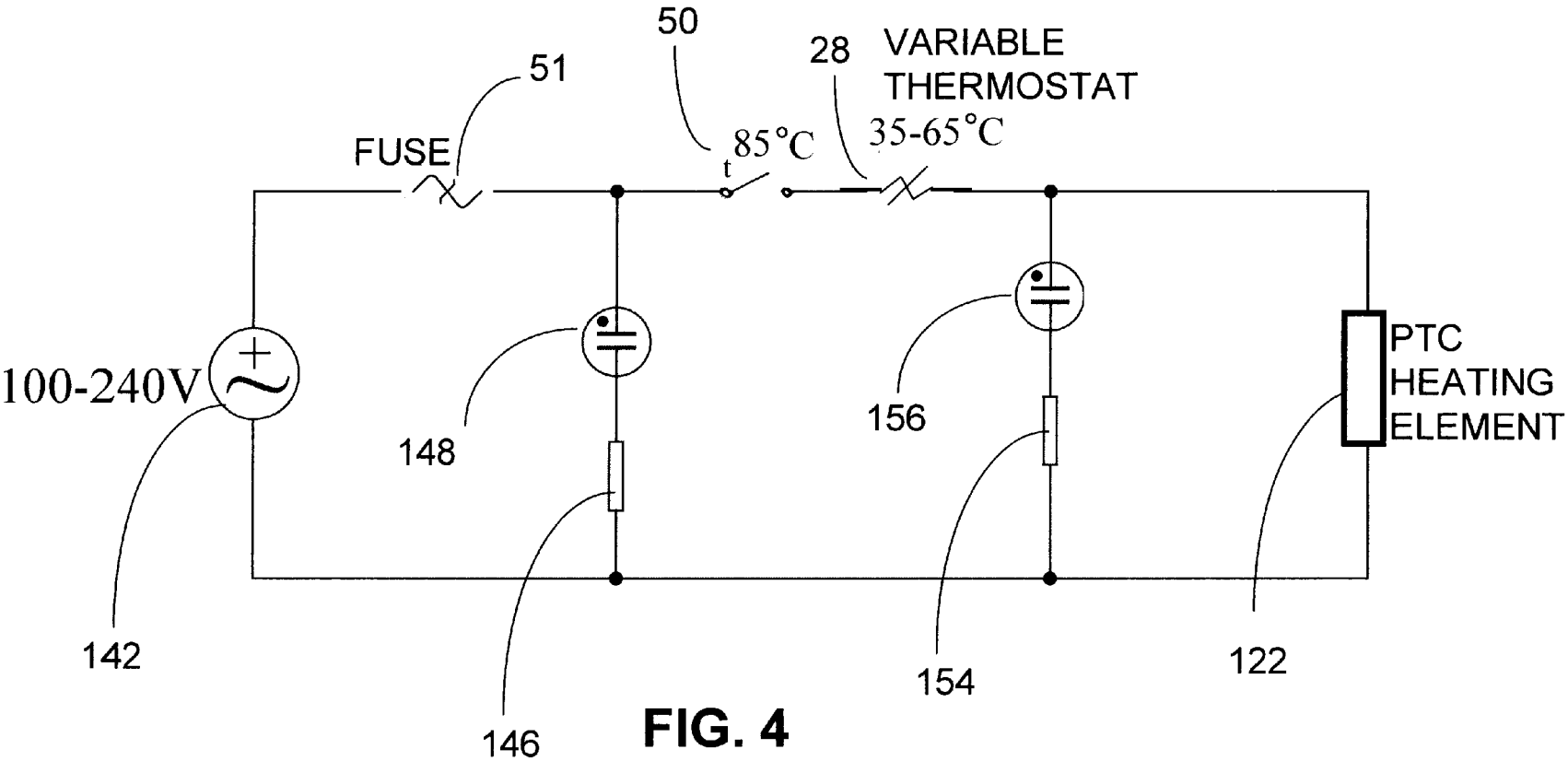
FIG. 4 is a circuit schematic for the paraffin wax warmer bath in accordance with the present invention.

FIG. 4 shows a circuit schematic for the paraffin wax warmer bath. The plug 60, shown in FIG. 1, plugs into alternating power source 142, which can be 100 to 240 volts alternating current (AC). In the United States the typical voltage is 110 volts, while in Europe the typical voltage is 220 volts. The present invention allows operation of the paraffin wax bath at either voltage. There is no ON/OFF switch required for the paraffin wax bath 10. The paraffin wax bath turns ON when plugged in and turns OFF when the bath is unplugged. When the unit is plugged in neon light 148 lights, because current passes through the neon light 148 in series with resistor 146. As described above, the power cutoff fuse 51 is an extra safety feature of the paraffin wax bath that blows or opens if the current through the fuse exceeds a certain limit, thereby removing power from the rest of the circuit including the PTC heating element 122. Under normal operation the current from the power source passes through power cutoff fuse 51 without any affect. The high current needed to blow the fuse would indicate a short or other fault in the paraffin wax bath.

Maximum temperature on-off switch 50 doesn't allow the temperature of the wax in the paraffin wax bath to exceed 85 degrees centigrade. If the temperature does exceed 85 degrees centigrade, then the maximum temperature on-off switch 50 opens removing power from the PTC heating element 122. When the temperature drops below 85 degrees centigrade, the maximum temperature on-off switch 50 will close thereby providing power to the PTC heating element 122.

Variable thermostat 28 sets the PTC heating element 122 temperature to be between 35 and 65 degrees centigrade by varying the resistance of the variable thermostat. Varying the resistance (R) of the variable thermostat 28 varies the remaining voltage that is applied across the PTC heating element 122, which sets the voltage (V) in the $P=V^2/R$, power(P) dissipation equation for the PTC heating element 122. When the variable thermostat resistance is set to be a high resistance, then more voltage from the 100–240V source is across the variable thermostat, so the voltage (V) across the PTC heating element 122 is lower, which lowers the power dissipation of the PTC heating element 122. This presets the PTC heating element 122 temperature toward the lower side of the 35 to 65 degree centigrade range. When the variable thermostat resistance is set to be a low resistance, then less voltage from the 100–240V source is across the variable thermostat, so the voltage (V) across the PTC heating element 122 is higher, which raises the power dissipation of the PTC heating element 122. This presets the PTC heating element 122 temperature toward the higher side of the 35 to 65 degree centigrade range. Once the variable thermostat is set, the voltage (V) across the PTC heating element 122 is a constant.

The PTC heating element 122 is temperature self regulating and its resistance varies as a function of temperature. The PTC heating element 122 resistance decreases as the temperature of the PTC heating element 122 decreases as heat is drawn away, thereby increasing the power dissipated by the PTC heating element 122 according to the $P=V^2/R$ equation. Since the voltage (V) is a constant as discussed above, as the resistance decreases, the current (I) through the PTC heating element increases according to $V=I*R$ equation. This self regulates the PTC heating element 122 temperature to raise the PTC temperature to the desired preset temperature. The PTC heating element 122 resistance increases as the temperature of the PTC heating element 122 increases, thereby decreasing the power dissipated by the PTC heating element 122 according to the $P=V^2/R$ equation. Again, since the voltage (V) is a constant as discussed above, as the resistance increases, the current (I) through the PTC heating element decreases according to $V=I*R$ equation. This again self regulates the PTC heating element 122 temperature to lower the PTC heating element 122 temperature to the desired preset temperature. The net effect is that the PTC heating element 122 temperature is maintained at a constant temperature.

Neon light 156, which is in series with resistor 154, is lit whenever power is applied to the PTC heating element 122. Whenever the maximum temperature on-off switch 50 opens because the temperature is above 85 degrees centigrade, neon light 156 is unlit. Also the brightness of neon light 156 varies according to the variable thermostat 28 setting. If the variable thermostat resistance is set to a high resistance (to set the PTC heating element 122 temperature lower), then neon light 156 is not as bright. If the variable thermostat 28 resistance is set to a low resistance (to set the PTC heating element temperature higher), then neon light 156 is brighter.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope of the present invention and additional fields in which the present invention would be of significant utility.

It is therefore intended by the appended claims to cover any and all such applications, modifications and embodiments within the scope of the present invention.

What is claimed is:

1. An apparatus for melting paraffin wax comprising:

an integral plastic inner tub comprising:

a first flat bottom having a first periphery;

a first sloped wall extending upward from the first periphery forming an open top having a second periphery; and first attachment points attached to the flat bottom;

an integral aluminum plate holder comprising:

a second flat bottom having a third periphery;

a second sloped wall extending upward from the third periphery and adapted so that the first sloped wall fits within the second sloped wall; and second attachment points attached to the second flat bottom;

wherein the second attachment points are removably attached to the first attachment points; and a positive temperature coefficient heating element coupled to the second bottom for providing self regulation to a preset temperature, the positive temperature coefficient heating element autonomously varying an positive temperature coefficient heating element electrical resistance in response to a temperature of the positive temperature coefficient heating element thereby varying a power dissipation of the positive temperature coefficient heating element in order to maintain the positive temperature coefficient heating element at the preset temperature;

wherein heat from the positive temperature coefficient heating element is transferred from the integral aluminum plate holder to the integral plastic inner tub via the first and second flat bottoms and first and second sloped walls thereby melting any wax inside said integral plastic inner tub; and the first sloped wall comprises an integral first alignment key;

the second sloped wall comprises an integral second alignment key for aligning the integral aluminum plate holder with the integral plastic inner tub;

a support mounted to the integral aluminum plate holder and aligned with the integral first and second alignment keys; and a variable thermostat for setting the preset temperature mounted to the support and coupled to the positive temperature coefficient heating element.

2. The apparatus for melting paraffin wax of claim 1 wherein:

the electrical resistance of the positive temperature coefficient heating element decreases in response to a temperature of the positive temperature coefficient heating element decreasing thereby increasing the power dissipation and the temperature of the positive temperature coefficient heating element; and the electrical resistance of the positive temperature coefficient heating element increases in response to the temperature of the positive temperature coefficient heating element increasing thereby decreasing the power dissipation and the temperature of the positive temperature coefficient heating element.

3. The apparatus of claim 1 wherein the positive temperature coefficient heating element further comprises:

an aluminum case;

two electrodes connected to the positive temperature coefficient heating element;

an insulated high temperature resistant sheet wrapped around the positive temperature coefficient heating element; and wherein the wrapped positive temperature coefficient heating element is inserted into the aluminum case from which the two electrodes protrude.

4. The apparatus of claim 1 further comprising:

a power source; and a variable thermostat for setting the preset temperature coupled between the power source and the positive temperature coefficient heating element.

5. The apparatus of claim 4 wherein the variable thermostat for setting the preset temperature comprises a variable resistor.

6. The apparatus of claim 4 further comprising a maximum temperature on-off switch mounted to the second bottom for sensing the temperature and coupled between the variable thermostat and the power source for preventing the temperature from exceeding a maximum temperature by decoupling the power source from the variable thermostat when the temperature exceeds the maximum temperature.

7. The apparatus of claim 6 wherein the maximum temperature is approximately 85 degrees centigrade.

8. The apparatus of claim 4 further comprising a power on indicator light coupled to the power source for indicating that power is applied to the apparatus for melting paraffin wax.

9. The apparatus of claim 6 further comprising a positive temperature coefficient heating element on indicator light coupled in parallel to the positive temperature coefficient heating element for indicating that power is applied to the positive temperature coefficient heating element.

10. The apparatus of claim 6 further comprising a fuse between the power source and the maximum temperature on-off switch.

11. The apparatus of claim 1 further comprising:

a plastic external tub mounted to the aluminum plate holder;

a plastic stand mounted to the plastic external tub;

a plastic grate removably placed within the integral plastic inner tub; and a plastic lid removably placed over open top of the integral plastic inner tub.

12. The apparatus for melting paraffin wax of claim 1 wherein:

the integral plastic inner tub further comprises a flaired lip extending outward and downward from the second periphery.

* * * * *